US006184484B1

(12) United States Patent
Wade, III

(10) Patent No.: US 6,184,484 B1
(45) Date of Patent: Feb. 6, 2001

(54) SWITCH WITH SLOTTED TERMINAL ARM

(75) Inventor: Clifton Wade, III, Florissant, MO (US)

(73) Assignee: Emerson Electric Co., St. Louis, MO (US)

( * ) Notice: Under 35 U.S.C. 154(b), the term of this patent shall be extended for 0 days.

(21) Appl. No.: 09/434,888

(22) Filed: Nov. 5, 1999

(51) Int. Cl.[7] ..... H01H 1/06; H01H 1/58
(52) U.S. Cl. ..... 200/284; 200/275
(58) Field of Search ..... 200/1 A, 6 C, 200/6 BB, 405, 407, 408, 239, 244, 245, 246, 250, 275, 283, 284

(56) References Cited

U.S. PATENT DOCUMENTS

| | | | | |
|---|---|---|---|---|
| 3,819,896 | * | 6/1974 | Aidn et al. | 200/166 J |
| 4,296,366 | | 10/1981 | Hildebrandt et al. | 318/793 |
| 4,670,725 | * | 6/1987 | Ahs | 335/142 |
| 5,111,010 | * | 5/1992 | Kokubu et al. | 200/461 |
| 5,446,251 | * | 8/1995 | Lin | 200/284 |
| 5,744,883 | | 4/1998 | Lewis et al. | 310/68 E |
| 6,013,883 | * | 1/2000 | Janniere | 200/250 |

* cited by examiner

*Primary Examiner*—Michael Friedhofer
(74) *Attorney, Agent, or Firm*—Howell & Haferkamp, LC

(57) ABSTRACT

A two position switch of an electric motor has an actuator that is biased by a resilient terminal arm into sliding engagement with an annular collar of a centrifugal actuator. The centrifugal actuator collar controls movement of the switch actuator which closes and opens electrical contacts to energize start and run winding circuits of the motor. The resilient terminal arm that closes the star circuit is slotted to reduce its biasing force exerted on the actuator of the switch.

17 Claims, 3 Drawing Sheets

SWITCH WITH SLOTTED TERMINAL ARM

BACKGROUND OF THE INVENTION (1) Field of the Invention

The present invention pertains to a switch for an electric motor. More specifically, the present invention pertains to a switch having a resilient terminal arm that is slotted to reduce its biasing force exerted on an actuator of the switch.

(2) Description of the Related Art

Common capacitor start and split phase induction motors have a run winding and a start winding wrapped around poles of a stator of the motor. An example of this type of motor is disclosed in the U.S. Patent of Hildebrandt et al. U.S. Pat. No. 4,296,366. The start winding of the motor stator is energized during start up of the motor, or when the operating speed of the motor falls below a specified operating speed. Energizing the start winding of the stator creates a rotating magnetic field in the stator that applies a sufficient torque to the rotor of the motor to begin rotation of the rotor. However, once the rotor has begun its rotation and has reached a desired operating speed, it is able to follow the alternations of the magnetic field created by the run windings of the stator and energizing the start windings is no longer needed. Commonly, in motors of this type, the start winding is not intended for continuous use and may fail if not de-energized during normal run operation of the motor. Therefore, motors of this type are typically operated by a two position switch having an actuator that is moveable between first and second positions. In the first position of the actuator it closes a first set of electrical contacts that establishes a circuit through the start windings of the motor, and in the second position of the actuator it closes a second set of electrical contacts that establishes a circuit through the run windings of the motor while opening the first circuit of the start windings.

Two position switches of this type are typically moved between their two positions by a centrifugal actuator assembly mounted on the rotor shaft of the motor. FIGS. 1 and 2 show a two position switch 12 of the prior art and a centrifugal actuator assembly 14 mounted on the rotor shaft 16 of a motor (not shown). The centrifugal actuator assembly 14 rotates with the motor shaft and is responsive to the speed of rotation of the shaft for moving the switch actuator 18 from its first or start position to its second or run position in response to the rotation of the motor shaft attaining a predetermined operating speed. Some centrifugal actuator assemblies 14 include an annular collar 22 that is mounted on the rotor shaft for axially shifting movement between two positions, a start position of the collar on the shaft shown in FIG. 1, and a run position of the collar on the shaft shown in FIG. 2.

The co-assigned U.S. Patents of Hildebrandt et al. U.S. Pat. No. 4,296,366 and Lewis et al. U.S. Pat. No. 5,744,883 each disclose a two position motor switch that is acted on by a centrifugal actuator assembly. These patents are incorporated herein by reference. The same type of switch 12 is shown in FIG. 3 and includes a switch actuator 18 that resembles a bell crank. The switch actuator 18 is mounted by a pivot connection 24 to the housing 26 of the switch. The switch actuator has an exterior arm 28 that extends from the pivot connection 24 to the exterior of the switch housing and an interior arm 32 that extends from the pivot connection 24 to the interior of the switch housing. The exterior arm 28 is provided with a follower surface 34 on a distal end of the arm that engages with the annular collar 22 of the centrifugal actuator assembly mounted on the motor shaft. The interior arm 32 engages with two resilient terminal arms in the interior of the switch housing. The first or start terminal arm 36 is fixed to the switch housing at its proximal end and has an electrical contact 38 at its distal end. The start terminal arm contact 38 engages a first or start winding electrical contact 42 in the switch housing to close the circuit through the start winding of the motor. The second or run terminal arm 44 also is fixed to the switch housing 26 at its proximal end and has an electrical contact 46 at its distal end. The run terminal arm contact 46 engages a second or run winding electrical contact 48 in the switch housing to close the circuit through the run winding of the stator. Thus, the switch actuator 18, with its exterior arm 28 in sliding engagement with the cam surface of the centrifugal actuator collar 22, moves between two positions in response to the axial movement of the collar between its two positions on the rotor shaft 16. In the first position of the collar shown in FIG. 1, it positions the switch actuator 18 in its start position relative to the switch housing 26. This closes the circuit through the first, start winding terminal arm 36 of the switch, energizing the start winding of the motor. The start position of the actuator 18 is shown in solid lines in FIG. 3. When the collar moves to its second, run position on the rotor shaft shown in FIG. 2, the exterior arm 22 of the switch actuator slides over the exterior cam surface of the collar 22 allowing the exterior arm to move radially inwardly relative to the rotor shaft 16. This movement of the exterior arm is caused by the resiliency of both the first and second terminal arms. The first 13 and second 14 terminal arms exert a biasing force on the interior arm 32 of the switch actuator. The biasing force causes the interior arm to pivot about the pivot connection 24 in the switch housing. As the interior arm is moved, the resiliency of the first terminal arm moves its electrical contact 38 out of engagement with the start winding electrical contact 42 of the start circuit, opening the start circuit. Also as the interior arm is moved, the resiliency of the second terminal arm moves its electrical contact 46 into engagement with the electrical contact 48 of the run winding, establishing a circuit through the run winding of the stator. The run position of the actuator 18 is shown in dashed lines in FIG. 3.

As stated above, movement of the switch actuator 18 that causes the exterior arm 28 to move radially inwardly toward the rotor shaft 16 of the motor is caused by a biasing force exerted on the interior arm 32 of the switch actuator by both the first, start terminal arm 36 and the second, run terminal arm 44. The resiliency of the two terminal arms results in the arms functioning as leaf springs that each exert a biasing force on the interior arm of the switch actuator. As shown in FIG. 3, first 52 an second 54 abutments on the interior arm 32 of the switch actuator engage the respective first 36 and second 44 terminal arms when the actuator is in the start position, causing the terminal arms to bow upwardly between their opposite ends. The biasing force exerted by the terminal arms holds the exterior arm follower surface 34 in sliding engagement with the collar 22 of the centrifugal actuator. The biasing force also causes the exterior arm of the switch actuator to move radially inward toward the rotor shaft in response to the axial movement of the centrifugal actuator assembly to its run position on the shaft.

Although the two position switch functions well for its intended purpose, it has been observed that the biasing force exerted by the first 36 and second 44 terminal arms on the interior arm 32 of the switch actuator causes the follower surface 34 on the exterior arm of the switch actuator to engage in sliding contact with the collar 22 of the centrifugal actuator assembly with a force that increases the wear rate of the follower surface. In addition, the wear rate problem of the follower surface cannot be overcome by simply reducing the biasing force of the terminal arms because the biasing force of the start terminal arm 36 must be sufficient to break a weld that often forms between the contact 36 of the start terminal arm and the start winding electric contact 42 of the switch.

When the start terminal arm contact 38 engages with the start winding electrical contact 42 of the switch, the amount of current that passes through the engaging contacts causes the contacts to go through a molten stage producing a weld between the contacts. The resiliency of the start terminal arm 36 must exert a sufficiently large biasing force on the interior arm 32 of the switch actuator to assist in biasing the switch actuator from its start position to its run position, but it must also be sufficiently large to cause the contact 38 of the start terminal arm to break the weld with the start winding electrical contact 42 of the switch and separate from the contact, opening the start winding circuit as the switch actuator moves from its start position to its run position.

SUMMARY OF THE INVENTION

The present invention overcomes the disadvantages of the prior art two position switch by providing a two position switch with a start terminal arm that exerts a reduced biasing force on the interior arm of the switch actuator while still being capable of exerting a sufficient force on the contact of the terminal arm to break a weld between the arm contact and the start winding electrical contact of the switch. The terminal arm of the invention is constructed in much the same manner as prior art terminal arms. The terminal arm has a generally rectangular configuration with longitudinally opposite proximal and distal ends. The proximal end is secured to the switch housing and the distal end has an electrical contact. Laterally spaced longitudinal edges extend along opposite sides of the arm between the proximal and distal ends.

The start terminal arm differs from the prior art terminal arm in that it is provided with at least one gap in the terminal arm between its proximal and distal ends. In the preferred embodiment, the gap is in the form of an oblong slot that passes through the terminal arm between the longitudinal edges of the arm. Alternatively, the gap could be provided by one or more holes through the arm, or by one or more notches in one or both of the longitudinal edges of the arm.

In the preferred embodiment, the slot opening extends longitudinally along the length of the terminal arm and has radiuses at its opposite ends. The slot is positioned in the terminal arm between the distal end of the arm and the area of the arm that comes into contact with the interior arm of the switch actuator.

Thus, with the material of the arm removed by the slot between the distal end of the arm and the portion of the arm engaged by the switch actuator, the section of the arm between the distal end and the switch actuator exerts a reduced biasing force on the switch actuator. This results in reduced wear of the follower surface on the exterior arm of the switch actuator. However, with the material of the terminal arm between the proximal end of the arm and the portion of the arm engaged by the actuator intact, the resiliency of the arm still exerts a sufficient force to break any weld that forms between the contact of the terminal arm and the electrical contact of the start winding of the switch.

BRIEF DESCRIPTION OF THE DRAWINGS

Further objects and features of the invention are revealed in the following detailed description of the referred embodiment of the invention and in the drawing figures wherein.

DETAILED DESCRIPTION OF THE PREFERRED EMBODIMENT

Figure 4:
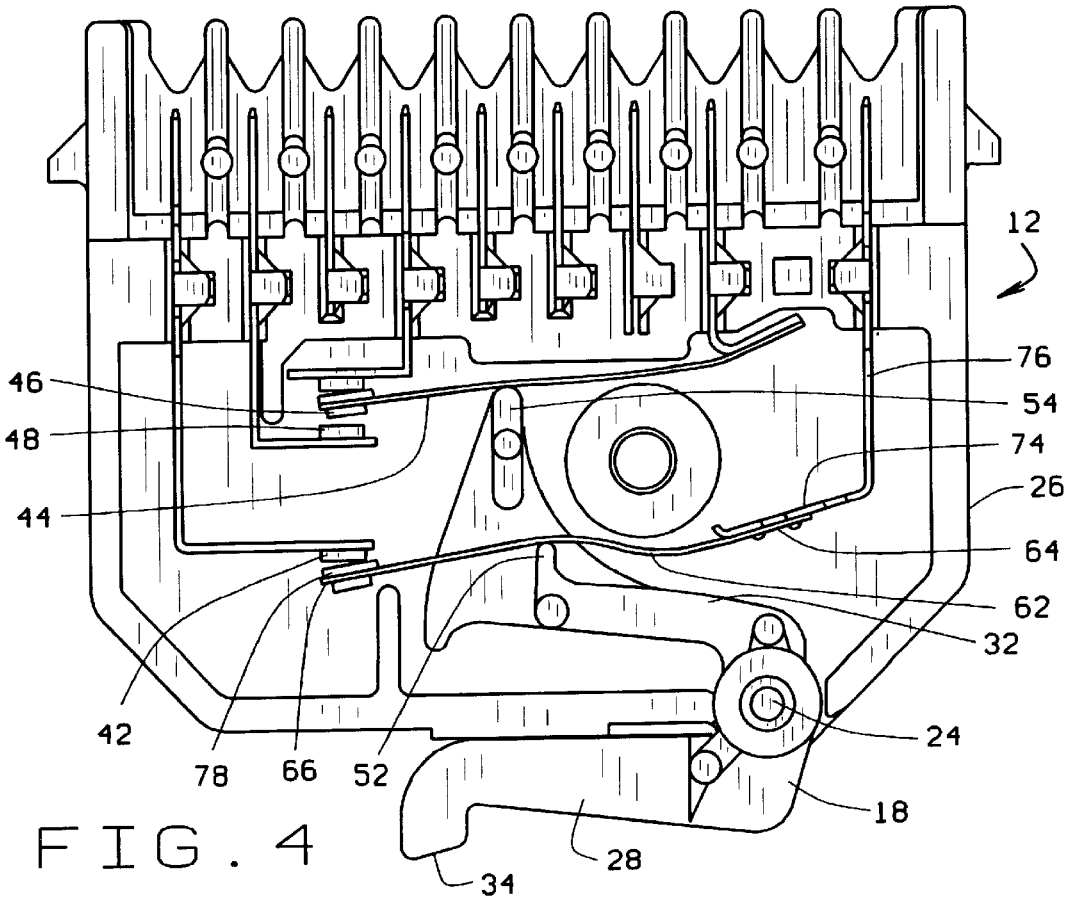
FIG. 4 is a view of a switch housing containing the start terminal arm of the invention with the switch actuator in its first, start position.
Figure 3:
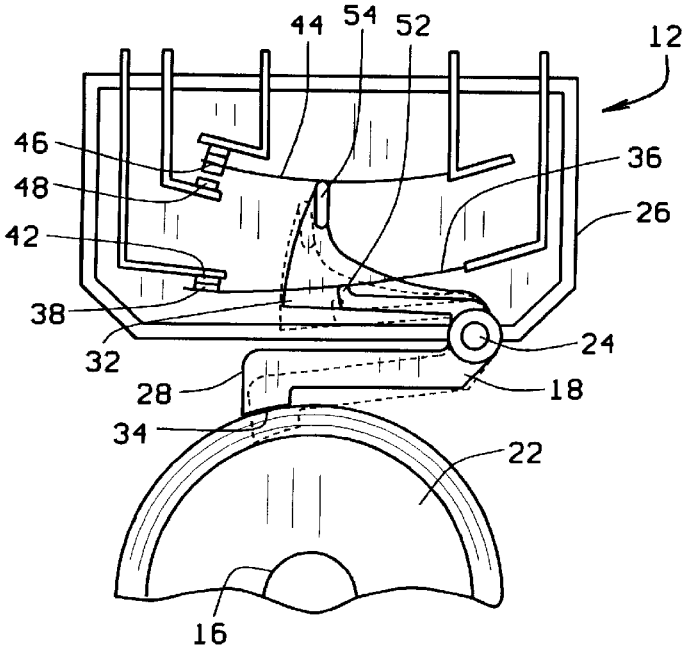
FIG. 3 PRIOR ART
FIG. 3 is a schematic representation of the prior art two position switch including the switch actuator and the start terminal arm and the run terminal arm of the switch, as well as a portion of the centrifugal actuator collar.
Figure 5:
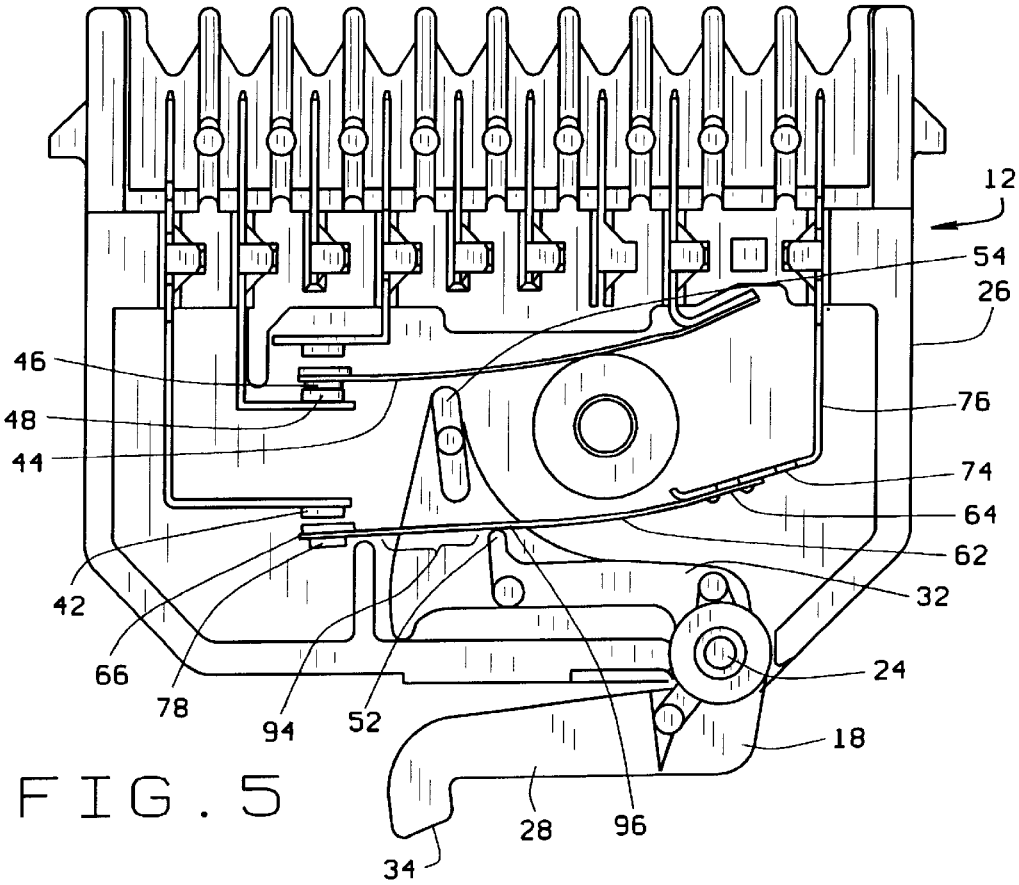
FIG. 5 is a view of the switch housing of FIG. 4 with the switch actuator in its second, run position.

FIG. 4 shows an actuator switch 18 employing the first or start terminal arm 62 of the invention. The actuator switch 18 is basically the same as the prior art actuator switch discussed earlier except for the substitution of the start terminal arm 62 of the invention for the start terminal arm 36 of the prior art. Thus, prior art component parts of the switch actuator 18 shown in FIG. 4 as well as in FIG. 5 are given the same reference numbers employed earlier in describing these component parts of the prior art actuator switch and their functioning. FIG. 4 shows the relative positions of the switch actuator 18 and the start terminal arm 62 of the invention in the start position of the switch actuator 18 and FIG. 5 shows the relative positions of the switch actuator and the start terminal arm 62 of the invention in the run position of the actuator.

Figure 6:
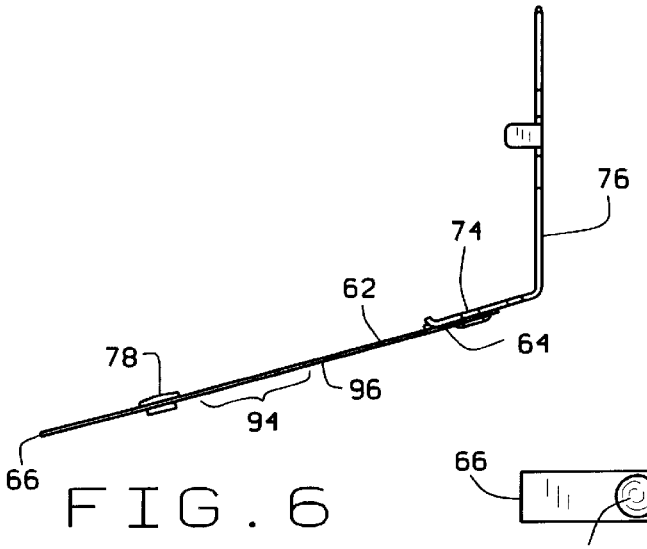
FIG. 6 is a side view of the terminal arm of the invention removed from the switch housing.

The first or start terminal arm 62 of the invention is constructed in much the same manner as the prior art terminal arms. The terminal arm 62 is constructed of a thin, resilient strip of metal having a generally rectangular configuration. The terminal arm 62 is shown removed from the switch housing 26 in FIGS. 6 and 7. In these figures, it can be seen that the rectangular configuration of the terminal arm has opposite proximal 64 and distal 66 ends. A pair of laterally spaced, longitudinal edges 68, 72 extend along the opposite sides of the arm between the proximal end 64 and the distal end 66 of the arm. The proximal end 64 of the arm is secured to a base portion 74 of an electrical plug 76 that is mounted in the switch housing. The electrical plug 76 is the same electrical plug employed with the prior start terminal arm. The proximal end 64 of the arm is secured to the base 74 of the plug by riveting, spot welding, or any other method conventionally employed in securing the terminal arm to the electrical plug. Adjacent the distal end 66 of the arm is the electrical contact 78 that engages with the start winding electrical contact 42 of the two position switch to establish a current through the start winding of the motor as described earlier. The electrical contact 78 is the same as that employed on the prior art terminal arm and is secured to the terminal arm by riveting, spot welding, or any other method commonly employed in securing the electrical contact to the terminal arm.

Figure 8:
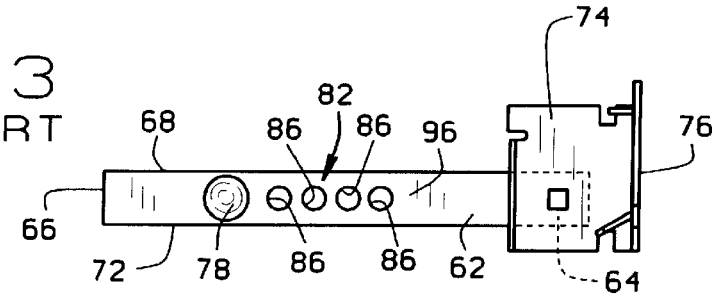
FIGS. 8–10 are plan views of variant embodiments of the terminal arm of the invention.
Figure 9:
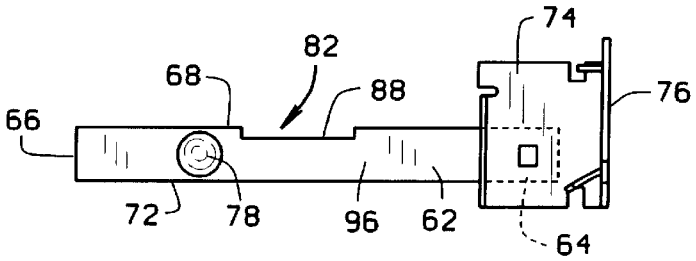
Figure 10:
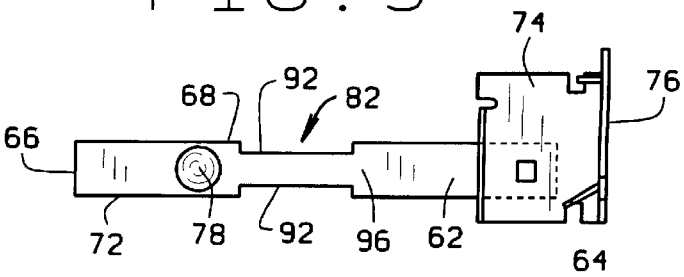

The start terminal arm 62 of the invention differs from the prior art terminal arm in that it is provided with at least one gap 82 in the terminal arm between its proximal and distal ends. In the preferred embodiment, the gap 82 has the form of an oblong slot that passes through the terminal arm between the longitudinal edges 68, 72 of the arm such as that shown in FIG. 7. Alternatively, the gap 82 could be provided by one or more holes 86 through the arm as shown in FIG. 8, by a single notch 88 in one of the longitudinal edges 68 of the arm as shown in FIG. 9, or by a pair of notches 92 formed in the opposite longitudinal edges 68, 72 of the arm as shown in FIG. 10. The preferred oblong slot 84 of FIG. 7 and the alternative holes 86 and notches 88, 92 of FIGS. 8–10 all remove material from a specific area of the arm and thereby increase the resiliency in this area of the arm while decreasing the biasing force of this area of the arm, as will be further explained.

Figure 7:
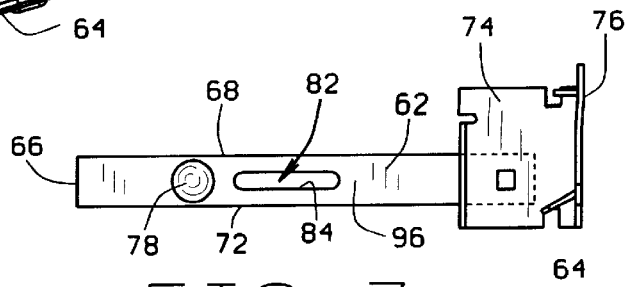
FIG. 7 is a plan view of the terminal arm of the FIG. 6.

As stated earlier, the preferred embodiment of the gap 82 is in the form of an oblong slot 84 shown in FIG. 7. The oblong slot 84 extends along a portion of the length of the arm adjacent its distal end 66. Preferably, the slot 84 is formed with radiuses at its opposite ends. Alternative embodiments could have angled or laterally extending edges at the ends of the slot. With the terminal arm 62 having a longitudinal length of 1.437" between its opposite proximal 64 and distal 66 ends, the longitudinal length of the slot 84 ranges from 0.30 to 0.50 of an inch, and the lateral width of the slot 84 ranges from 0.06 to 0.15 of an inch. In the preferred embodiment of the terminal arm, the slot 84 has a longitudinal length of 0.40 of an inch and a lateral width of 0.11 of an inch.

In referring to FIG. 4, it can be seen that the longitudinal positioning of the slot 84 in the terminal arm 62 (designated by the bracket 94) positions the slot between the distal end 66 of the arm and an area 96 of the arm that will come into engagement with the first abutment 52 of the interior arm 32 of the switch actuator 18.

FIG. 4 shows the position of the switch actuator 18 relative to the start terminal arm 62 of the invention in the start position of the switch actuator. As seen in FIG. 4, the first abutment 52 of the switch actuator interior arm engages an area 96 of the start terminal arm 62 that is intermediate the distal 66 and proximal 64 ends of the arm. In addition, the gap 82 in the arm 62 is positioned entirely between the electrical contact 78 on the distal end of the arm and the area of the arm 96 engaged by the switch actuator abutment. It can be seen in FIG. 4 that the engagement of the first abutment 52 of the actuator interior arm 32 with the terminal arm 62 causes the arm to bow upwardly between its proximal and distal ends when the switch actuator 18 is in the start position. The biasing force exerted by the first or start terminal arm 62 on the abutment 52 of the switch actuator 18 is the combination of the biasing force of that portion of the terminal arm between its proximal end 64 secured to the electrical plug base 74 and the area of the arm 96 engaging the first abutment, and that portion of the arm between the distal end 66 of the terminal arm engaging the start winding contact 42 and the area of the arm 96 engaging the first abutment 52 of the actuator switch. By the presence of the gap 82 in the terminal arm eliminating material of the terminal arm between the distal end 66 of the arm and the area of the arm 96 engaging the first abutment 52, the biasing force of this portion of the terminal arm is reduced from that of the prior art terminal arm that does not have a gap and does not have material removed from this portion of the arm. Thus, the terminal arm of the invention exerts a reduced biasing force on the switch actuator 18 from that of the prior art start terminal arm. This results in the follower surface 34 of the switch actuator exterior arm 28 engaging in sliding contact with the centrifugal actuator collar 22 at a reduced force, thus reducing the wear rate of the follower surface against the collar.

Figure 1:
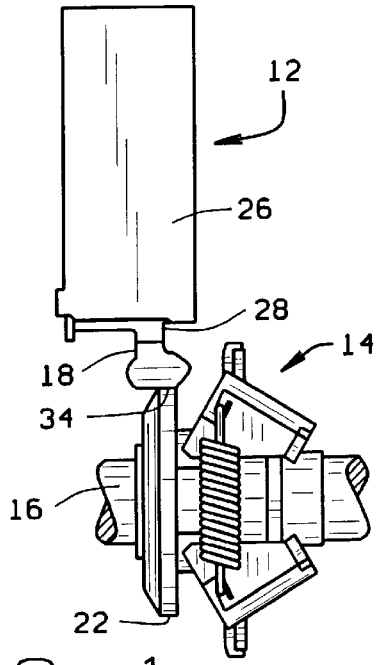
FIG. 1 PRIOR ART
FIG. 1 is a schematic representation of a side elevation view of the prior art two position motor starting switch with the exterior arm of the switch actuator in sliding engagement with a peripheral surface of an annular collar of a centrifugal actuator assembly mounted on a rotor shaft.
Figure 2:
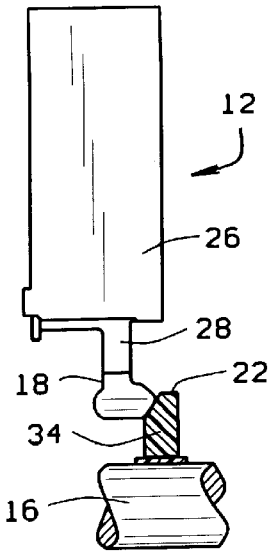
FIG. 2 PRIOR ART
FIG. 2 is a view similar to FIG. 1, but showing the position of the exterior arm of the actuator in sliding engagement with the annular collar when the arm has moved to its second, run position relative to the collar.

When the annular collar 22 of the centrifugal actuator moves from its start position shown in FIG. 1 to its run position shown in FIG. 2, the follower surface 34 of the switch actuator 18 begins to move radially toward the rotor shaft 16 of the motor and the switch actuator 18 begins to move from its start position shown in FIG. 4 to its run position shown in FIG. 5. The movement of the switch actuator is caused by the biasing force of the start terminal arm 62 exerted on the first abutment 52 of the switch actuator interior arm and by the biasing force of the run terminal arm 44 on the second abutment 54 of the switch actuator interior arm. As the switch actuator moves toward the run position, the biasing force exerted by the start terminal arm 62 on the first abutment 52 of the switch actuator is lessened until eventually the first abutment 52 of the interior arm disengages from the area of engagement 96 on the start terminal arm 62 and the switch actuator is biased solely by the run terminal arm 44. At this point, the start terminal arm 62 no longer exerts a biasing force against the switch actuator 18 and all of the resilient biasing force of the start terminal arm 62 is directed toward breaking the weld contact between the electrical contact 78 of the arm and the start winding contact 42 of the switch. Because the start terminal arm 62 cantilevers from its connection to the base 74 of the switch electrical plug 76, the resilient force of the arm needed to break the weld between the arm electrical contact 78 and the switch start winding contact 42 is primarily provided by that portion of the arm between the arm proximal end 64 and the area of the arm 96 that was previously in engagement with the first abutment 52 of the switch actuator. Thus, the removal of the material of the terminal arm 62 by the gap 82 does not appreciably affect its resilient force devoted to breaking the weld between the arm electrical contact 78 and the start winding contact 42 of the switch. Because the portion of the terminal arm between the proximal end 64 and the area of the arm 96 that engages with the switch abutment is unaffected by the removal of material from the terminal arm by the gap 82, the start terminal arm 62 of the invention maintains a minimum of 60 grams of force to break the weld between the arm electrical contact 68 and the start winding contact 42 of the switch.

Thus, with the material of the arm removed by the gap between the distal end of the arm and the portion of the arm engaged by the switch actuator abutment, the section of the arm between the arm distal end and the switch actuator exerts a reduced biasing force on the switch actuator. This results in reduced wear of the follower surface on the exterior arm of the switch actuator. However, with the material of the terminal arm between the proximal end of the arm and the portion of the arm engaged by the switch actuator intact, the resiliency of the arm still exerts a sufficient force to break any weld that forms between the electrical contact of the terminal arm and the start winding contact of the switch.

While the present invention has been described by reference to a specific embodiment, it should be understood that modifications and variations of the invention may be constructed without departing from the scope of the invention defined in the following claims.

What is claimed:

1. A switch comprising:

a switch housing;

an electrical contact secured to the switch housing;

a terminal arm having opposite proximal and distal ends, the proximal end is secured to the switch housing and the distal end is moveable between first and second positions relative to the switch housing where in the first position the distal end contacts the electrical contact and in the second position the distal end is spaced from the electrical contact, the terminal arm having at least one gap in the arm between the proximal and distal ends;

a switch actuator mounted to the switch housing for movement of the actuator between first and second positions of the switch actuator relative to the switch housing, the switch actuator engages the terminal arm between its proximal and distal ends and moves the terminal arm between the first and second positions in response to the switch actuator moving between the respective first and second positions; and the switch actuator engages the terminal arm between the at least one gap and the proximal end of the terminal arm with there being no gaps in the terminal arm between where the switch actuator engages the terminal arm and the proximal end of the terminal arm.

2. The switch of claim 1, wherein:

the terminal arm is a rectangular strip with a longitudinal length between the proximal and distal ends and a pair of laterally spaced, longitudinal edges that extend between the proximal and distal ends, and the at least one gap in the terminal arm is positioned between the longitudinal edges.

3. The switch of claim 2, wherein:

the at least one gap is a single hole through the terminal arm.

4. The switch of claim 2, wherein:

the at least one gap is a single, longitudinally extending slot in the arm.

5. The switch of claim 4, wherein:

the slot has a longitudinal length ranging from 0.30 of an inch to 0.50 of an inch.

6. The switch of claim 5, wherein:

the slot has a lateral width ranging from 0.06 of an inch to 0.12 of an inch.

7. The switch of claim 4, wherein:

the slot has a longitudinal length of 0.40 of an inch.

8. The switch of claim 7, wherein:

the slot has a lateral width of 0.11 of an inch.

9. A switch comprising:

a switch housing;

an electrical contact secured to the switch housing;

a terminal arm having opposite proximal and distal ends, the proximal end is secured to the switch housing and the distal end is moveable between first and second positions relative to the switch housing where in the first position the distal end contacts the electrical contact and in the second position the distal end is spaced from the electrical contact, the terminal arm having at least one gap in the arm between the proximal and distal ends;

a switch actuator is mounted to the switch housing for movement of the actuator between first and second positions of the switch actuator relative to the switch housing, the switch actuator engages the terminal arm between its proximal and distal ends and moves the terminal arm between the first and second positions in response to the switch actuator moving between the respective first and second positions; and the at least one gap is positioned on the terminal arm between the switch actuator and the distal end of the terminal arm with there being no gaps in the terminal arm between where the switch actuator engages the terminal arm and the proximal end of the terminal arm.

10. The switch of claim 9, wherein:

the terminal arm is a rectangular strip with a longitudinal length between the proximal and distal ends and a pair of laterally spaced, longitudinal edges that extend between the proximal and distal ends, and the at least one gap in the terminal arm is positioned between the longitudinal edges.

11. The switch of claim 10, wherein:

the at least one gap is a single hole through the terminal arm.

12. The switch of claim 10, wherein:

the at least one gap is a single, longitudinally extending slot in the arm.

13. A switch comprising:

a switch housing;

an electrical contact secured to the switch housing;

a switch actuator mounted to the switch housing for movement of the switch actuator between first and second positions of the switch actuator relative to the switch housing;

a terminal arm having a length with opposite proximal and distal ends, the proximal end of the terminal arm is secured to the switch housing, the switch actuator engages the terminal arm between the proximal and distal ends and the length of the terminal arm from the proximal end is flexible enabling the distal end of the terminal arm to move between first and second positions in response to movement of the switch actuator between the respective first and second positions, where in the first position of the distal end the distal end contacts the electrical contact and in the second position of the distal end the distal end is spaced from the electrical contact;

the terminal arm has at lease one gap in the length of the terminal arm; and the switch actuator engages the terminal arm between the at least one gap and the proximal end of the terminal arm with there being no gaps in the terminal arm between where the switch actuator engages the terminal arm and the proximal end of the terminal arm.

14. The switch of claim 13, wherein:

the terminal arm is a rectangular strip with a longitudinal length between the proximal and distal ends and a pair of laterally spaced, longitudinal edges that extend between the proximal and distal ends, and the at least one gap in the terminal arm is positioned between the longitudinal edges.

15. The switch of claim 14, wherein:

the at least one gap is a single hole through the terminal arm.

16. The switch of claim 14, wherein:

the at least one gap is a single, longitudinally extending slot in the arm.

17. A switch comprising:

a switch housing;

an electrical contact secured to the switch housing;

a switch actuator mounted to the switch housing for movement of the switch actuator between first and second positions of the switch actuator relative to the switch housing;

a terminal arm having a length with opposite proximal and distal ends, the proximal end of the terminal arm is secured to the switch housing, the switch actuator engages the terminal arm between the proximal and distal ends and the length of the terminal arm from the proximal end is flexible enabling the distal end of the terminal arm to move between first and second positions in response to movement of the switch actuator between the respective first and second positions, where in the first position of the distal end the distal end contacts the electrical contact and in the second position of the distal end the distal end is spaced from the electrical contact;

the terminal arm has at least one gap in the length of the terminal arm; and the at least one gap is positioned on the terminal arm between the switch actuator and the distal end of the terminal arm with there being no gaps in the terminal arm between where the switch actuator engages the terminal arm and the proximal end of the terminal arm.

* * * * *

UNITED STATES PATENT AND TRADEMARK OFFICE

CERTIFICATE OF CORRECTION

PATENT NO. : 6,184,484 B1
DATED : February 6, 2001
INVENTOR(S) : Amin et al.

It is certified that error appears in the above-identified patent and that said Letters Patent is hereby corrected as shown below:

Title page,
Item [75], in the inventor section: "Satyanarayana" insert -- D.V.

Column 1,
Line 45, "trimesters" should read -- tri-esters --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*